US006073381A

United States Patent [19]

Farrar et al.

[11] Patent Number: 6,073,381

[45] Date of Patent: Jun. 13, 2000

[54] UNIVERSAL THIN WALLED FINGER GROOVE ADAPTER

[76] Inventors: Frank W. Farrar, 11941 Paseo Bonita, Los Alamitos, Calif. 90720; Jack R. Farrar, 11855 E. Cog Hill Dr., Whittier, Calif. 90601

[21] Appl. No.: 09/118,465

[22] Filed: Jul. 17, 1998

[51] Int. Cl.[7] ..... F41C 23/10

[52] U.S. Cl. ..... 42/71.02

[58] Field of Search ..... 42/71.01, 71.02

[56] References Cited

U.S. PATENT DOCUMENTS

| | | | |
|---|---|---|---|
| 3,815,270 | 6/1974 | Pachmayr | 42/71.02 |
| 4,043,066 | 8/1977 | Pachmayr et al. | 42/71.02 |
| 4,132,024 | 1/1979 | Pachmayr et al. | 42/71.02 |
| 4,286,401 | 9/1981 | Pachmayr et al. | 42/71.02 |
| 4,315,379 | 2/1982 | Lang | 42/71.02 |
| 4,359,833 | 11/1982 | Pachmayr et al. | 42/71.02 |
| 4,998,367 | 3/1991 | Leibowitz | 42/71.02 |
| 4,999,941 | 3/1991 | Farrar | 42/71.02 |
| 5,231,237 | 7/1993 | Cupp | 42/71.02 |
| 5,465,520 | 11/1995 | Cupp | 42/71.02 |
| 5,560,136 | 10/1996 | Cupp | 42/71.02 |
| 5,621,997 | 4/1997 | Pearce | 42/71.02 |
| 5,768,817 | 6/1998 | Simons | 42/71.02 |
| 5,797,207 | 8/1998 | Marable et al. | 42/71.02 |
| 5,857,279 | 1/1999 | De Oliveira Masina | 42/71.01 |

*Primary Examiner*—Charles T. Jordan
*Assistant Examiner*—Denise J Buckley
*Attorney, Agent, or Firm*—Bruce A. Jagger

[57] ABSTRACT

A thin walled finger groove adapter for a handgun comprising a very thin ductile metal reinforcing plate encapsulated with thin front and back layers of elastomeric material. At least one finger groove projection is provided on the front surface of the adapter in registry with a hole through the reinforcing plate so that the projection is integral with both the front and back layers of encapsulating material. The finger groove adapter is substantially no greater than 0.040 inches thick with the metal plate being no more than about 0.015, and preferably about 0.010, inches thick. It is well suited for handgun users who have small hands. The finger groove adapter is molded in a flat condition and may be trimmed in the flat configuration to a variety of final shapes so as to accommodate mounting to a variety of different handgun handles. The finger groove adapter is sold in the flat or only slightly bent configuration, and is deformed into the appropriate shape for mounting to the handgun by the user.

15 Claims, 4 Drawing Sheets

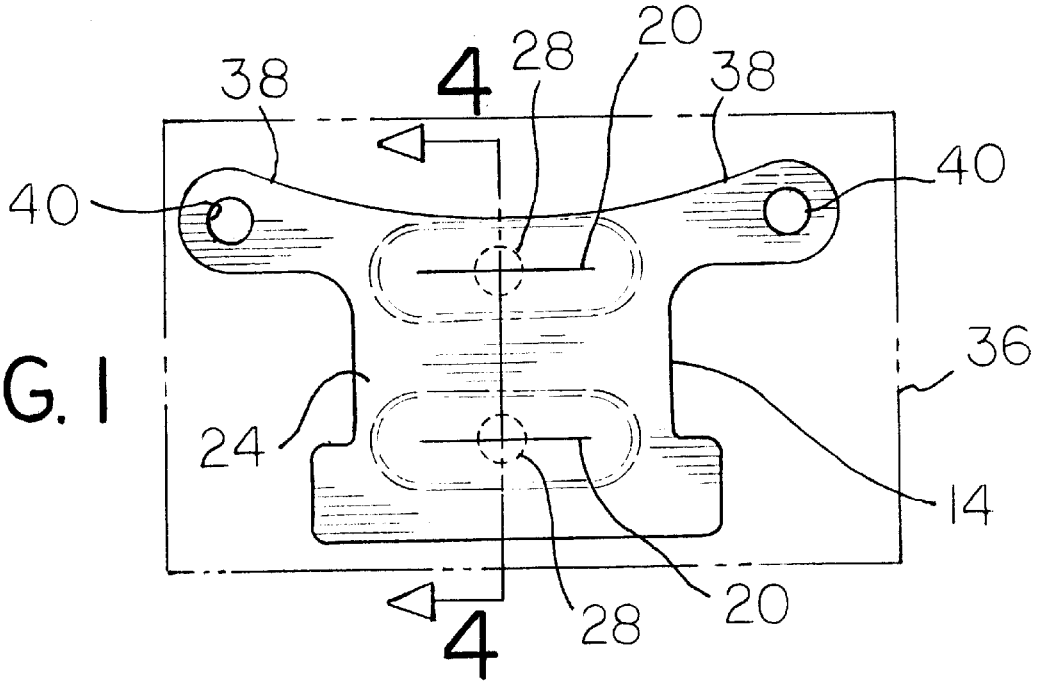
FIG. 1
FIG. 2
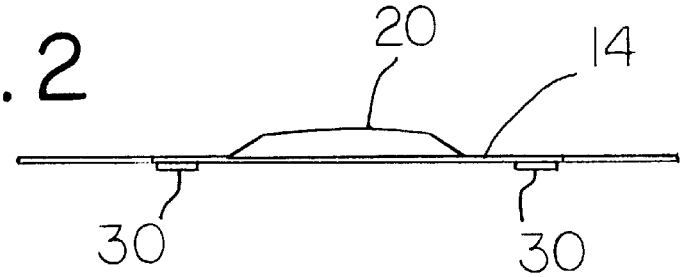
FIG. 3
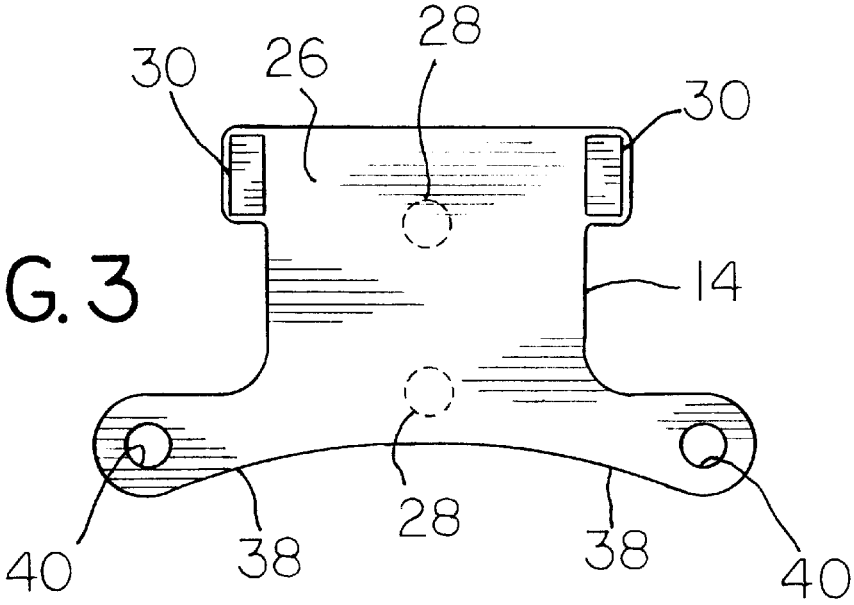

FIG. 4
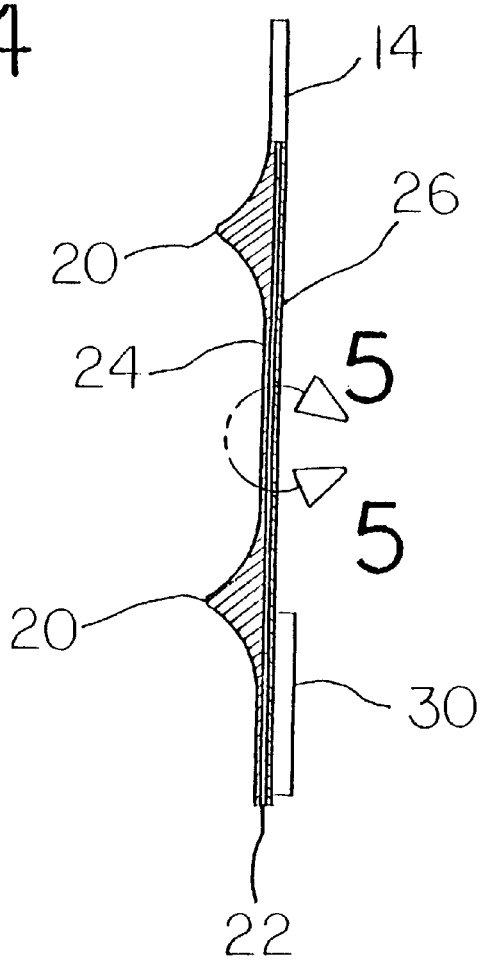
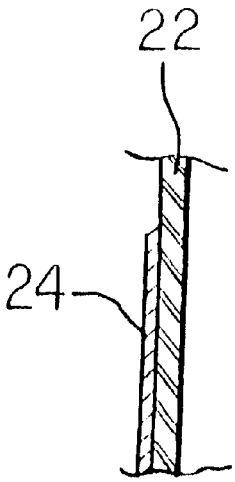
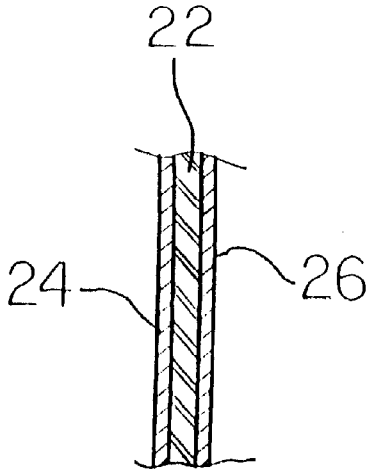
FIG. 5
FIG. 8

UNIVERSAL THIN WALLED FINGER GROOVE ADAPTER

BACKGROUND OF THE INVENTION

1. Field of the Invention

The invention relates in general to handgun finger groove adapters, and, in particular, to a thin walled finger groove adapter for mounting on the front strap of a handgun.

2. Description of the Prior Art

There have been many attempts to develop a variety of different grips for handguns for various purposes, such as, for instance, to provide cushion, to absorb shock, to increase the bulk of the gun handle, and the like. See, for example, the following U.S. Patents, Cupp U.S. Pat. No. 5,231,237, Pachmayr et al. U.S. Pat. No. 4,043,066, and Pachmayr et al. U.S. Pat. No. 4,132,024.

In particular, attempts have been made to provide separate, and sometimes integral, elastomeric finger grips to the front strap portion of the handle beneath the trigger of the gun. Raville U.S. Pat. No. 3,901,125 shows one such wrap around finger adapter without finger grip protrusions that is of substantial thickness. Leibowitz U.S. Pat. No. 4,998,367 shows a thick gel encapsulated grip having two recesses which the fingers of the user can grasp. Pearce U.S. Pat. No. 5,621,997 shows a thick finger adapter grip that is integral with side portion grips which is composed of an elastic material having horizontal finger grip protrusions for the purpose of adding bulk to the handle of a gun. Cupp U.S. Pat. No. 5,465,520 shows another finger adapter composed of an elastomeric material having finger grip protrusions in the wrap-around portion of the adapter. Pachmayr et al. U.S. Pat. No. 4,286,401 shows still another finger adapter composed of an elastic material which engages a shoulder of the gun handle and is held in place with substantially rigid side grip panels.

Recently, and particularly in the area of law enforcement, individuals, who have hands smaller than average, have found a need for improved hand gun grips. These users, with smaller hands, desire comfortable accuracy enhancing hand grips which reduce the bulk of the gun handle yet provide the grip which is necessary for accuracy. However, grips which utilize elastomeric materials in order to provide better feel and accuracy, undesirably add bulk to the grip. This bulk is necessitated by the nature of the elastomeric material which, if made thin, is susceptible to movement, stretching or tearing during the normal wear and tear imposed on the gun. To reduce this problem the elastomeric material can be made thinner by selecting a material having a greater Shore hardness value, however, as the material is made harder, the desired non-slip feel of the grip is reduced.

Those concerned with these problems recognize the need for an improved finger groove adapter for hand guns that is extremely thin, very durable, and provides the comfort and utility afforded by the use of elastomeric materials. Also, the adapter must be easy to apply by hand.

None of the above patents disclose the structural features or advantages of the thin finger groove adapter according to the present invention. The thin finger groove adapter of the present invention can be produced with an extremely thin wall thickness of, for example, approximately 0.010 to 0.015 inches or less. This is to be compared to the typical thickness of about 0.0625 and greater, of other adapters. Finger groove adapters according to the present invention are extremely thin, very durable, easy to install, and are comfortable for handgun users who have small hands or desire less bulk. In addition, the unique manner in which the finger groove adapters of the present invention are produced is readily adapted to the production of a wide variety of finger groove adapters for different handguns using common adjustable tooling. It is thus possible to use substantially the same molds for different handgun models.

BRIEF SUMMARY OF THE INVENTION

A preferred embodiment of the thin walled finger adapter for a handgun comprises a very thin metal reinforcing plate having front and back surfaces with a layer of slip resistant elastomeric material bonded to each surface. The elastomeric material is slip resistant in that the hand does not slip on it. It is not, however, tacky to the point where the hand tends to stick to the surface. Such material by itself in an unreinforced configuration generally tears and distorts easily. The finger adapter of the present invention is unique in that the total thickness is no greater than approximately 0.040, and preferably, less than about 0.020 inches thick, except in the area where horizontal finger grip protrusions are provided, if desired. Where finger grip protrusions are to be provided, at least one aperture is formed in the metal reinforcing plate beneath each protrusion. The apertures or holes through the reinforcing plate allow the front and back layers of elastomeric material to integrally bond into one mass through the apertures. This increases the strength and stabilizes the position of the associated finger grip protrusions. The finger groove adapter of the present invention is extremely thin, yet it is unexpectedly durable and unsusceptible to tearing or stretching. In the preferred embodiment, brass is used for the metal reinforcing plate and nitrile rubber is used as the elastomeric material of the front and back layers. Other ductile metals such as stainless steel, copper, aluminum, alloys thereof, and the like, and other elastomeric materials may be used, as desired, without departing from the scope and spirit of the present invention. In general, the metals should not be significantly springy or resilient, that is, when bent to the shape of the front strap of a gun they should generally hold the bent configuration when released.

Uniquely, the molding of the finger groove adapter is completed while the initially rectangular shaped reinforcing plate is in a substantially flat configuration, yet it can be bent and installed by hand. This substantially simplifies the molding process, and permits the same molds, usually with small reversible adjustments, to be used for different models of handguns. The thinness of the reinforcing plate permits it to be bent and installed by hand by the user. After molding, while the finger groove adapter is still in the flat configuration, it is trimmed to its final configuration. Because it is trimmed flat, the trimming tooling is inexpensive, simple and easily reconfigured. This process is advantageous, when compared to the prior expedients, because the finger groove adapter in the flat configuration can be easily and conveniently molded and trimmed to accommodate a wide variety of handgun configurations, without the need to produce entirely separate molds and trimming tools for each application. In addition, manufacturing costs are reduced since generally flat molds are less expensive and are easier to work with in controlling the quality of the product produced, as compared to curved surface molds.

In a preferred embodiment, the finger groove adapter is configured, for example, for use with the Baretta 8000/8040 Cougar handgun by a final trimming process. The trimming process produces opposed mounting arms having mounting holes. On the back layer of elastomeric material, raised tabs are provided to engage the gun handle structure. Standard side panel grips are used to cooperably restrain the mounting arms and raised tabs of the finger adapter with the handle of the handgun. Mounting screws for the side panel grips engage the mounting holes in the finger adapter to firmly secure the adapter to the handle of the handgun. These various mounting members serve to restrain the adapter in all axes in the desired location on the front strap of the gun.

The finger groove adapter of the present invention is preferably sold to the handgun user in the flat configuration. The user deforms the adapter by hand to a generally U-shaped configuration matching that of the front strap of the handgun. The mounting members are located on the sides or mounting arms of the adapter. The mounting members are thus positioned to engage with the frame of the gun. The now U-shaped adapter is installed on the handle such that the raised tabs engage the rigid frame in the handle on either side of the front strap, and the side panel grips are installed over the mounting arms of the adapter. Side panel grip screws are mounted through the grips and the mounting holes in the mounting arms to complete the installation. Due to the extremely thin profile of the adapter of the present invention, it may be advantageously installed under nearly any side panel grip, such as, for instance, the original side panels provided by the gun manufacturer, and the like. If desired, the side panel grips can be configured to enhance the engagement between the raised tabs of the adapter and the handgun frame.

The finger adapter of the present invention is advantageous for users of handguns who have small hands. Such users desire a thin elastomeric grip which does not add significant bulk to the grip, yet is durable and unsusceptible to tearing, shifting or stretching during the normal use of the handgun. The finger adapter of the present invention provides the advantages of a finger grip adapter, yet it is preferably no thicker overall than approximately 0.010 inches.

Other objects, advantages, and novel features of the present inventing will become apparent from the following detailed description of the invention when considered in conjunction with the accompanying drawings.

BRIEF DESCRIPTION OF THE DRAWINGS

The present invention provides its benefits across a broad spectrum of hand grips, and in particular to finger groove adapters for handguns. While the description which follows hereinafter is meant to be representative of a number of such applications, it is not exhaustive. As those skilled in the art will recognize, the basic methods and apparatus taught herein can be readily adapted to many uses. It is applicant's intent that this specification and the claims appended hereto be accorded a breadth in keeping with the scope and spirit of the invention being disclosed despite what might appear to be limiting language imposed by the requirements of referring to the specific example disclosed.

Referring particularly to the drawings for the purposes of illustration only and not limitation:

FIG. 1 is a plan view of a preferred embodiment of the invention.

FIG. 2 is a side view of the embodiment shown in FIG. 1.

FIG. 3 is a bottom view of the embodiment shown in FIG. 1.

FIG. 4 is a cross sectional view taken along line 4—4 in FIG. 1.

FIG. 5 is a partial cross sectional view taken along line 5—5 in FIG. 4.

FIG. 8 is a partial cross sectional view similar to FIG. 5 showing a further embodiment of the invention.

DETAILED DESCRIPTION OF THE PREFERRED EMBODIMENTS

Figure 6:
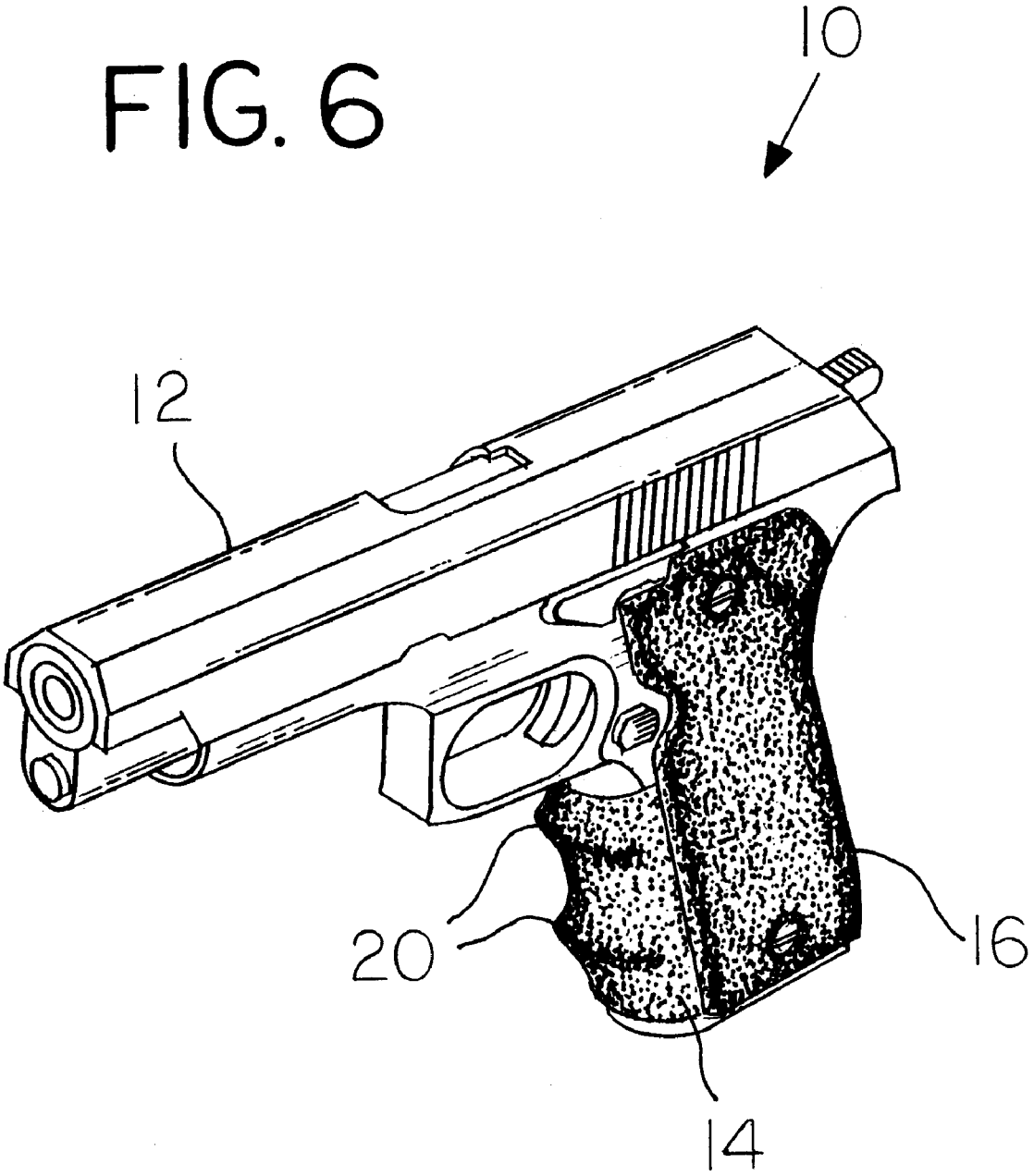
FIG. 6 is an isometric view of the embodiment of FIG. 1 used in conjunction with side panel grips and attached to a handgun.
Figure 7:
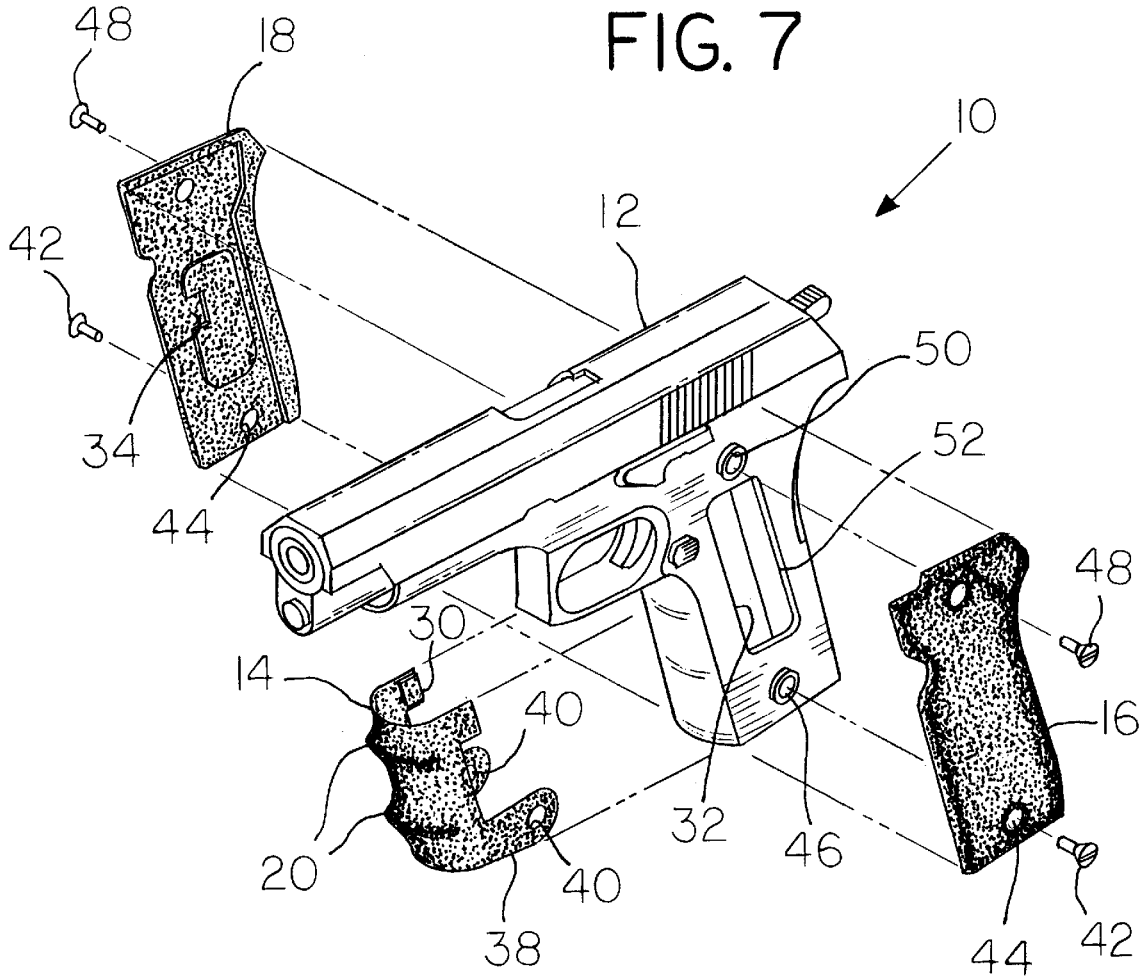
FIG. 7 is an exploded isometric view of the embodiment of FIG. 6.

Referring now to the drawings wherein like reference numerals designate identical or corresponding parts throughout the several views, particularly in FIGS. 6 and 7 there is illustrated generally at 10 a hand gun assembly having attached side panel grips and the finger groove adapter of the present invention. Handgun 12, as illustrated, is a Baretta 8000/8040 Cougar model, with a finger groove adapter 14 of the present invention, and side panel grips, 16 and 18, attached. Likewise, the finger groove adapter 14, with only slight modification to its final trimming, can be used in conjunction with handguns other than the illustrated Baretta 8000/8040 Cougar.

The total thickness of finger groove adapter 14 is no greater than 0.040 inches, and preferably less than approximately 0.015 inches, except in the area where finger grip protrusions 20 are provided. Many of the tactile advantages of the present invention are achieved even in a less preferred embodiment where finger grip protrusions 20 are omitted from the adapter. In general, however, the finger grip protrusions significantly enhance accuracy and comfort. Due to its laminated construction, finger groove adapter 14 is remarkably thin, extremely durable, and is not susceptible to stretching, moving or tearing during heavy use.

Referring particularly to FIGS. 1 through 5, the construction of the laminated finger groove adapter is shown. The construction of the finger groove adapter is commenced with the provision of a thin flat metallic reinforcing plate 22. Plate 22 generally has a thickness of less than about 0.015, and preferably less than about 0.010 and more than about 0.002 inches. The preferred thickness depends in part on the nature of the metal used in the reinforcing plate. In one embodiment, a brass plate having a thickness between about 0.006 and 0.004 inches was used. With stainless steel, thickness of from about 0.004 to 0.002 inches can be used. Excellent results have been achieved with the use of brass, however, other deformable materials may be used, such as, for example, copper, stainless steel, aluminum, alloys thereof, and the like. Different elastomers can be employed in different layers, if desired.

The surfaces of reinforcing plate 22 are prepared for the bonding of thin layers of an elastomeric material by cleaning and abrading the front and back faces to remove oxides and other contaminates which tend to interfere with bonding. An adhesive is then applied to the reinforcing plate while in the flat configuration, and the plate is encapsulated with elastomeric material in a mold (not shown). The elastomeric material is preferably injected into the mold on each side of the flat plate where it reacts with the adhesive and bonds to the front and back surfaces of the reinforcing plate. In one embodiment, nitrile rubber is injected into the mold adding a minimum thickness of, for example, about 0.003 to 0.002 inches of elastomer on each side of the plate. The elastomeric layers are illustrated as being of substantially the same thickness. This is not, however, necessary to the practice of the invention. The layers can be unsymmetrical as to thickness, if desired. The laminated adapter is preferably trimmed to its final shape while it is still in the flat configuration. In general, it is preferred that the adapter be as thin as possible. To this end, for example, a stainless steel plate having a thickness of 0.002 inches with layers of elastomer having thickness of less than about 0.002 inches each, provides an adapter with an overall thickness of less than about 0.006 inches. Brass plates are generally used with a minimum thickness of about 0.004 inches to provide adapters of less than about 0.008 inches total thickness. Such extremely thin finger groove adapters are nonetheless durable and dimensionally stable when installed on the front strap of a gun so as to provide the desired grip, feel and accuracy. Hand installation is facilitated by the very ductile nature of the thin metal.

It is important to note that the present invention finger groove adapter is capable of being molded in a flat configuration. At final assembly to the handgun, because of the thinness of the metal plate, the adapter is hand deformable by the user into a U-shaped configuration about the front strap of the handgun. Mold construction is simple and inexpensive. This substantially reduces manufacturing costs compared to prior expedients utilizing U-shaped molds. The simple flat molds can be adapted, with small reversible changes, to make finger groove adapters for a variety of handguns.

The embodiment of the finger groove adapter which is illustrated in FIGS. 1 through 5 comprises, for example, a brass reinforcing plate 22 encapsulated in front and back layers, 24 and 26, respectively, of elastomeric material. The front layer of elastomeric material 24 includes integral finger grip protrusions 20 to assist the user in properly grasping the handgun. Apertures 28 are provided in the brass reinforcing plate 22 beneath each finger grip protrusion 20 thus allowing the front and back layers of elastomeric material to integrally bond together through the apertures into one unitary mass in the region of the protrusions 20. The apertures 28, thus significantly increase the strength and stability of the finger grip protrusions. For application to the illustrated Baretta 8000/8040 Cougar handgun, two tabs 30 are formed in the opposed mounting arms of the back layer 26 of elastomeric material. Tabs 30 project outwardly from the plane of the adapter and are adapted to securely engage edges 32 of opening 52 of the frame of the handgun 12. Referring particularly to FIG. 7, a recess 34 is provided in each of side panel grips, 16 and 18, to firmly secure the finger groove adapter at its raised tabs 30 with the edges 32 of the frame. Other mounting configurations can be used, as desired.

It has been found very advantageous to mold the finger groove adapter while the initially rectangular shaped reinforcing plate is in a substantially flat configuration. Shown in phantom line in FIG. 1 at 36 is the initial flat shape of the reinforcing plate. Preferably, the finger groove adapter is trimmed to its final configuration after the molding operation is complete.

In a preferred embodiment shown in FIGS. 1 through 7, the finger groove adapter 14 is trimmed to produce outward mounting arms 38 with mounting holes 40. Referring particularly to FIG. 7, mounting holes 40 are positioned to securely mount the finger adapter to the handgun frame at threaded inserts 46. The finger groove adapter is installed under the side panel grips 16 and 18 with raised tabs 30 engaging edges 32 of the frame. The raised tabs 30 are firmly secured in place by the recesses 34 of the side panel grips, 16 and 18. Mounting holes 40 are positioned in registry with threaded inserts 46 on either side of the frame. Mounting screws 42 are installed in apertures 44 of side panel grips, 16 and 18, through mounting holes 40 of the adapter, and into threaded inserts 46 in the handgun frame. If desired, the finger groove adapter can be trimmed to eliminate tabs 30 and provide additional mounting arms and mounting holes for similar attachment to the handgun handle utilizing mounting screws 48 and threaded inserts 50. As those in the art will appreciate, the ability to trim the finger groove adapter of the present invention in nearly an infinite number of configurations makes the adapter universally adaptable to a wide variety of handguns without requiring a separate set of tooling for each application.

The finger groove adapter of the present invention is sold to the handgun user in the flat configuration. The user deforms the adapter to a U-shaped configuration to wrap around the front strap of the gun, just prior to assembly. Thus, the function of the reinforcing plate is not to keep the adapter rigid, but rather to be easily deformable while, at the same time, providing structural reinforcement to the thin layers of elastomeric material. Due to the extremely thin profile of the adapter of the present invention, it may be advantageously installed with nearly any side panel grip, such as, for instance, the original side panels provided by the gun manufacturer, and the like. Once the user positions the finger groove adapter on the handgun handle, the user then positions the side panel grips 16 and 18 on the frame and installs mounting screws 42 and 48 to complete the assembly, as shown in FIGS. 6 and 7.

Preferably, the overall thickness of the adapter is less than about 0.015 inches. Where thicker adapters are used, generally they must be associated with specially made mating grips. The mating grips have recessed regions to receive the thick adapter mounting arms. Because of the necessity of using especially made matching parts, this is generally not preferred.

Obviously many modifications and variations of the present invention are possible in light of the above teachings. It is therefore to be understood that, within the scope and proper application of the appended claims, the invention may be practiced otherwise than as specifically described.

What is claimed is:

1. A thin walled finger adapter for a handgun handle installed in conjunction with standard side panel grip elements, comprising:

a deformable reinforcing plate formed of ductile metal and having front and back faces, said faces being bonded with respective front and back layers of an elastomeric material, said reinforcing plate having a thickness of no greater than approximately fifteen thousandths of an inch, said finger adapter having at least two opposed mounting members adapted to anchor said finger adapter to said handgun handle, said finger adapter having an initial substantially planer configuration, and said finger adapter being adapted to being deformed by hand to fit said handgun handle.

2. A thin walled finger adapter as recited in claim 1 wherein said metal reinforcing plate is between about 0.006 about and 0.004 inches thick.

3. A thin walled finger adapter as recited in claim 1 having a total thickness substantially no greater than about 0.015 inches.

4. A thin walled finger adapter as recited in claim 1 having a total thickness no greater than approximately 0.040 inches.

5. A thin walled finger adapter as recited in claim 1 wherein said front layer of elastomeric material includes at least one finger grip protrusion of elastomeric material extending outwardly from said front layer of elastomeric material, said reinforcing plate including at least one hole extending therethrough, said front and back layers of elastomeric material being continuous through said hole in the region of said finger grip protrusion.

6. A thin walled finger adapter as recited in claim 1 wherein said metal reinforcing plate is brass.

7. A thin walled finger adapter as recited in claim 1 wherein said metal reinforcing plate is stainless steel.

8. A thin walled finger adapter as recited in claim 1 wherein said metal reinforcing plate is aluminum.

9. A thin walled finger adapter as recited in claim 1 wherein said elastomeric material is nitrile rubber.

10. A deformable thin walled finger groove adapter for removable mounting on a front strap of a handgun installed in conjunction with conventional side panel grip elements, comprising:

a deformable reinforcing plate formed of a sheet of metal having front and back faces and a thickness less than about 0.010 inches, each said face being bonded to a layer comprised of an elastomeric material, said layers having a combined thickness of less than approximately 0.030 inches, said layer on said front face forming an external surface adapted to be gripped by a user without slipping, and said layer on said back face forming an internal surface adapted to engage the surface of said handgun handle without slipping, said thin walled finger groove adapter having an initial generally planar configuration and being adapted to being deformed by hand to fit said front strap; and at least one finger grip protrusion of elastomeric material unitary with both of said layers and extending outwardly from said front face.

11. A thin walled finger adapter as recited in claim 10 wherein said external surface is textured.

12. A method of forming a thin walled finger adapter for a handgun handle, comprising the steps of:

selecting a flat plate composed of a ductile deformable metal and having front and back surfaces, and a thickness of less than approximately 0.015 inches;

forming at least one hole through said flat plate in the mid-region thereof;

abrading said front and back surfaces;

coating said front and back surfaces with an adhesive;

encapsulating said flat plate with an elastomeric material while said flat plate is maintained in a flat configuration thereby forming elastomeric external and internal surfaces to form an encapsulated flat plate; and deforming said encapsulated flat plate by hand to conform to said handgun handle.

13. A method of forming a thin finger groove adapter for a handgun handle as recited in claim 12, including selecting a flat plate having a thickness of less than about 0.010 inches, and forming at least one finger groove protrusion on said front surface in association with said hole.

14. A method of forming a thin finger groove adapter for a handgun handle as recited in claim 12, further comprising trimming said finger groove adapter to a pre-determined shape before deforming said encapsulated flat plate.

15. A method of forming a thin finger groove adapter for a handgun handle as recited in claim 14, wherein said handgun handle includes a front strap, said method further comprising bending said finger groove adapter by hand to conform to the shape of said front strap.

* * * * *